US008997318B2

(12) United States Patent
Nicolas et al.

(10) Patent No.: US 8,997,318 B2
(45) Date of Patent: Apr. 7, 2015

(54) MAGNETIC CLASP

(71) Applicant: The Swatch Group Research and Development Ltd, Marin (CH)

(72) Inventors: Cedric Nicolas, Neuchatel (CH); Patrick Ragot, Fontainemelon (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 13/924,807

(22) Filed: Jun. 24, 2013

(65) Prior Publication Data

US 2014/0000312 A1 Jan. 2, 2014

(30) Foreign Application Priority Data

Jun. 27, 2012 (EP) ..... 12173916

(51) Int. Cl.

| | |
|---|---|
| ***A44C 5/04*** | (2006.01) |
| ***A44C 5/20*** | (2006.01) |
| ***A44C 5/14*** | (2006.01) |
| *H01F 7/02* | (2006.01) |

(52) U.S. Cl.

CPC ..... *A44C 5/04* (2013.01); *A44C 5/2071* (2013.01); *H01F 7/0263* (2013.01); *A44D 2203/00* (2013.01); *A44C 5/14* (2013.01)

(58) Field of Classification Search

CPC ..... A44C 5/04; A44C 5/14; A44C 5/2071; A44D 2203/00

USPC ..... 24/71 J, 303, 265 WS; 63/3.2

See application file for complete search history.

(56) References Cited

U.S. PATENT DOCUMENTS

| | | | | | |
|---|---|---|---|---|---|
| 2,389,298 | A | * | 11/1945 | Ellis | 335/303 |
| 4,197,618 | A | * | 4/1980 | Bourguignon | 24/303 |
| 4,399,595 | A | * | 8/1983 | Yoon et al. | 24/303 |
| 4,527,311 | A | * | 7/1985 | Aoki | 24/303 |
| 4,941,236 | A | * | 7/1990 | Sherman et al. | 24/303 |
| 5,307,582 | A | * | 5/1994 | Quintel | 40/633 |

(Continued)

FOREIGN PATENT DOCUMENTS

| | | |
|---|---|---|
| EP | 1 980 170 A1 | 10/2008 |
| FR | 2 834 622 A1 | 7/2003 |

(Continued)

OTHER PUBLICATIONS

European Search Report for application No. EP 12 17 3916, dated Dec. 5, 2012.

*Primary Examiner* — Robert J Sandy
*Assistant Examiner* — David Upchurch
(74) *Attorney, Agent, or Firm* — Sughrue Mion, PLLC

(57) ABSTRACT

A bracelet including flexible end parts arranged to overlap each other in the closed position of the bracelet. The bracelet includes a first magnetic circuit portion integrated in one of the end parts and a second magnetic circuit portion integrated in the other end part, the magnetic circuit portions being arranged to mutually attract each other to unite the two end parts in the closed position of the bracelet. One end part includes second magnetic circuit portions which are arranged parallel to each other and spaced apart from each other to enable the length to be selected. The magnetic circuit portions include a soft ferromagnetic alloy yoke arranged transversely to the bracelet and parallel to the surface of the end part in which the magnetic circuit portion is integrated. The first magnetic circuit portion includes bipolar magnets arranged between the yoke and the contact surface of the end part.

10 Claims, 3 Drawing Sheets

(56) References Cited

U.S. PATENT DOCUMENTS

| | | | | |
|---|---|---|---|---|
| 6,301,754 | B1 * | 10/2001 | Grunberger et al. | 24/303 |
| 7,817,002 | B2 * | 10/2010 | Fullerton et al. | 335/306 |
| 2005/0102802 | A1 | 5/2005 | Sitbon et al. | |
| 2008/0256979 | A1 * | 10/2008 | Okamura | 63/3.1 |
| 2008/0282517 | A1 * | 11/2008 | Claro | 24/303 |
| 2009/0289090 | A1 * | 11/2009 | Fullerton et al. | 224/183 |
| 2012/0216374 | A1 | 8/2012 | Manuello | |

FOREIGN PATENT DOCUMENTS

| | | | |
|---|---|---|---|
| GB | 2 355 281 | A | 4/2001 |
| WO | 2004/063821 | A2 | 7/2004 |
| WO | 2011/048344 | A1 | 4/2011 |

* cited by examiner

MAGNETIC CLASP

This application claims priority from European Patent Application No. 12173916.3 filed Jun. 27, 2012, the entire disclosure of which is incorporated herein by reference.

FIELD OF THE INVENTION

The present invention concerns a bracelet or wristband with a magnetic clasp comprising permanent magnets and it concerns, in particular, a watch bracelet comprising this type of magnetic clasp.

PRIOR ART

FIG. 10d of FR Patent No 2 834 622 illustrates a watch bracelet with a magnetic clasp comprising first and second flexible strands, both strands being separable and arranged to overlap each other in the closed position of the bracelet. The bracelet further comprises two magnetic elements; the first bracelet strand includes a first magnetic element which is fixed, whereas the second strand, in the form of a hollow shaft, includes a second magnetic element, called the "moveable element", which is arranged to slide longitudinally, as a friction tight fit, inside the hollow shaft. When the strands are in the closed position, the two magnetic elements are opposite each other and mutually attract each other. Thus, the two magnetic elements enable the two strands to be secured to each other in the closed position of the bracelet. Moreover, it is possible to adjust the length of the bracelet by sliding the moveable magnetic element inside its hollow shaft. Further, the Patent document teaches that it is possible to adjust the bracelet length simply by sliding one of the strands longitudinally against the other in the closed position of the bracelet. Indeed, provided that the force of attraction exerted by the fixed magnetic element on the moveable magnetic element is sufficient to overcome the friction force, sliding one strand over the other causes the moveable magnetic element to slide inside its hollow sheath.

However, this known solution has certain drawbacks. Indeed, if the force of attraction between the magnetic elements is not sufficient to overcome the friction force, it will be impossible to adjust the bracelet length. Conversely, if the moveable magnetic element slides too easily inside the hollow shaft, the bracelet is liable to be impossible to tighten sufficiently.

BRIEF SUMMARY OF THE INVENTION

It is an object of the present invention to overcome the drawbacks of the prior art that have just been described. The present invention achieves this object by providing a bracelet with a magnetic clasp conforming to the annexed claim 1.

One advantage of the invention is that it is possible to select the length of the bracelet simply by choosing which one of the plurality of second magnetic circuit portions is placed in a superposed position with the first magnetic circuit portion. Further, if none of the second magnetic circuit portions is superposed exactly on the first magnetic circuit portion, the mutual attraction existing between the first magnetic circuit portion and the closest second magnetic circuit portion is normally sufficient to bring said second portion into a superposed position.

Another advantage of the invention is that the use of an entire row of bipolar magnets, instead of a single magnet, enables the contact surfaces of the two end parts to be better secured to each other in the closed position of the bracelet.

Further, the presence of a yoke made of soft ferromagnetic alloy in each magnetic circuit portion has the advantage of channelling the magnetic field properly, and thus of further increasing the mutual force of attraction between the first and second magnetic circuit portions.

According to an advantageous variant of the present invention, the length of the ferromagnetic yokes is greater than half the length of the end parts of the bracelet. Owing to this feature, the strap-shaped end parts may be flexible lengthwise yet relatively rigid widthwise. This feature has the advantage of enabling the bracelet both to adopt the shape of a wrist and to ensure proper adherence between the contact surfaces in the closed position of the bracelet.

According to another advantageous variant of the invention, the space between two second magnetic circuit portions is at least equal to three-quarters of the width of one of the second magnetic circuit portions. This feature has the advantage of enabling the bracelet to adopt the shape of the wrist of the person wearing it.

According to an advantageous embodiment of the invention, several first magnetic circuit portions are integrated in the first end part, said first portions being arranged parallel to each other and spaced apart from each other. This multiplication of the magnetic circuit portions proportionally increases the magnetic force of attraction which unites the contact surfaces of the two end parts in the closed position of the bracelet.

According to an advantageous variant of this latter embodiment, the first magnetic circuit portions which are integrated in the first end part are spaced further apart from each other than the second magnetic portions which are integrated in the second end part. Indeed, in the closed position, the first end parts is on the external side of the ring formed by the bracelet, whereas the second end part is on the internal side. In these conditions, it will be clear that the same given angle subtends a longer arc of a circle on the external end part than on the inner end part. The feature whereby the first magnetic circuit portions are spaced further apart from each other than the second magnetic circuit portions thus corrects the overlapping effect of the end parts and ensures that the first and second magnetic circuit portions are properly aligned in the closed position of the bracelet.

According to a preferred embodiment of the latter variant above, the space between the second magnetic circuit portions gradually decreases away from the end of the second end part of the bracelet. Indeed, the further away the second magnetic circuit portions (on which the first magnetic circuit portions are superposed) are from the end of the bracelet, the tighter the bracelet will be, or, in other words the smaller the diameter of the bracelet will be. In these conditions, it will be clear that the tighter the bracelet is, the more necessary it will be to reduce the space between the second magnetic circuit portions in order to correct the overlapping effect of the end parts and to ensure that the first and second magnetic circuit portions are properly aligned in the closed position of the bracelet.

According to another advantageous variant of the aforementioned embodiment, the second magnetic circuit portions each include a row of bipolar magnets arranged between the ferromagnetic yoke of the second portion and the contact surface of the second end part; the directions of polarisation of the magnets of one row are parallel to each other and normal to the contact surface of the second end part. Further, the rows of magnets of the first and second magnetic circuit portions all have the same number of magnets; the magnets are arranged so that the magnets of the first portions are each matched with a magnet of a second portion in the closed position of the bracelet, two matched magnets being superposed and polarised in the same direction. The feature whereby the first and second magnetic circuit portions each include magnets, in the configuration described above, further increases the magnetic force of attraction between the contact surfaces.

According to another advantageous embodiment of the invention, the direction of polarisation of certain magnets of a row is in the opposite direction to the direction of polarisation of the other magnets of the same row. This feature has the advantage of better channelling the magnetic field in the magnetic circuit portions. According to an advantageous variant of this latter embodiment, each magnet in a row of magnets is polarised in the opposite direction to its closest neighbour in the row of magnets. This latter feature has the effect of shortening the path travelled by the magnetic field, and thus of intensifying the magnetic field in immediate proximity to the contact surfaces.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF EMBODIMENTS

Figure 1:
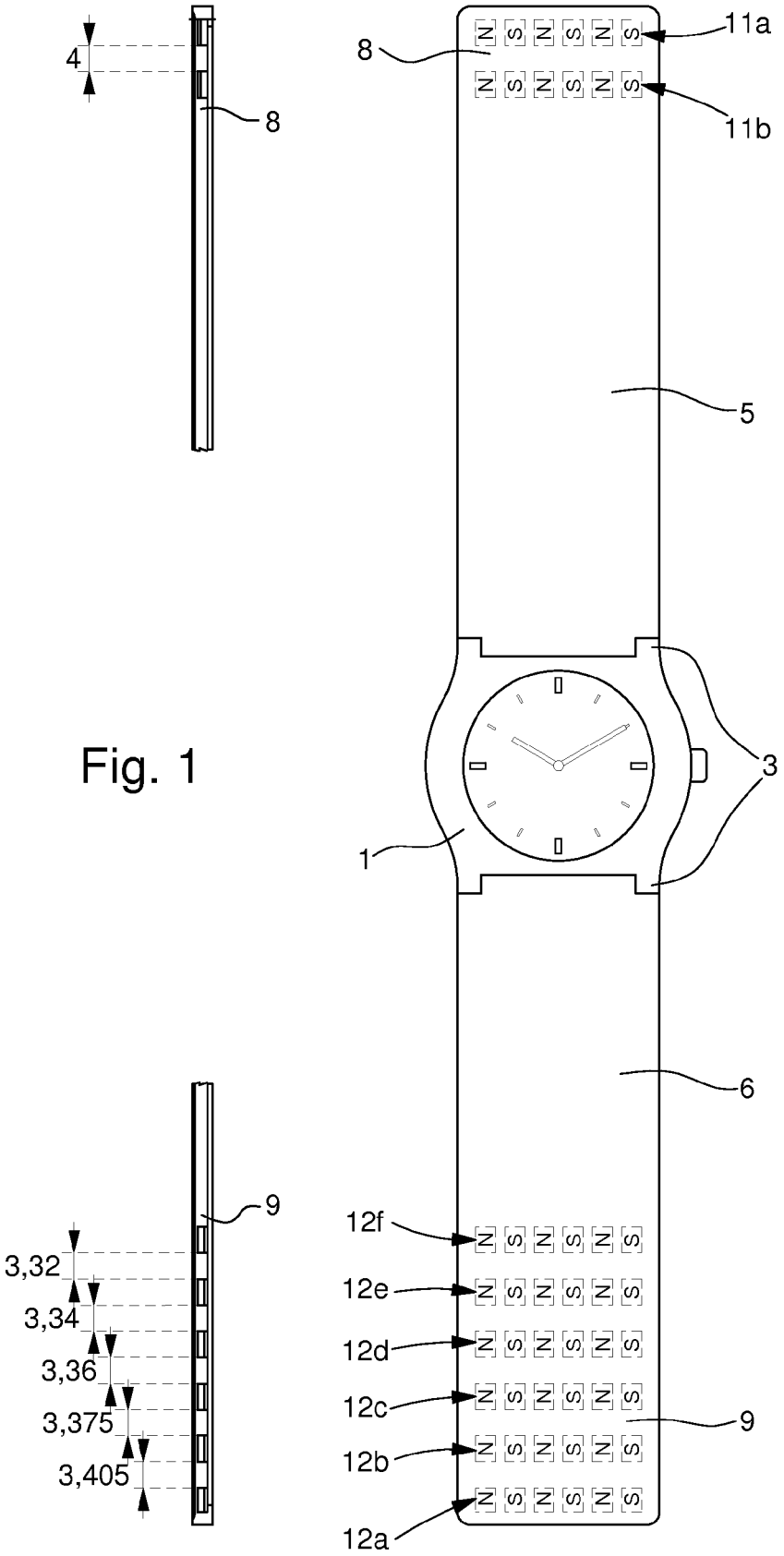
FIG. 1 combines a top plan view and a partial side cross-sectional view of a wristwatch corresponding to a first embodiment of a bracelet with a magnetic clasp according to the invention, the two bracelet strands being shown in the open position to show their end parts clearly.

Referring to FIG. 1, there is shown a wristwatch according to a first embodiment of the invention. The wristwatch includes a watch case 1 having two pairs of horns 3, to which the two bracelet strands 5 and 6 are attached. In the embodiment described, the strands are made of elastomer, which provides them with the flexibility required to wind around the wrist of the person wearing the watch. Strands 5, 6 each include an end part, and these two end parts are respectively referenced 8 and 9 in FIGS. 1, 2*a* and 2*b*. It will also be noted that in the closed position, as illustrated by the schematic view of FIGS. 2*a* and 2*b*, the end parts overlap each other defining an overlapping area. The end parts thus each have a contact surface which is arranged to adjoin the contact surface of the other end part in the closed position of the bracelet. It will also be noted that, in the overlapping area, the end part 8 of the first strand (referenced 5) is on the outside of the ring formed by the bracelet in the closed position, whereas the end part 9 of the second strand (referenced 6) is on the inner side of this ring.

Figure 2A:
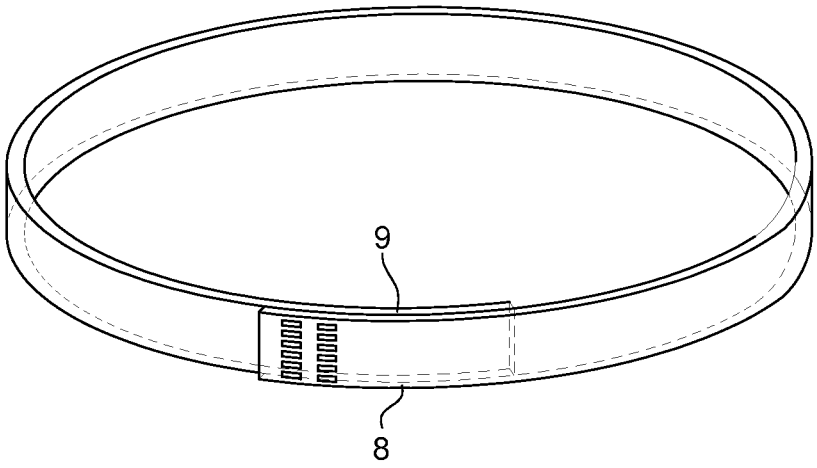
FIG. 2*a* shows a schematic, perspective view of the wristwatch of FIG. 1 in the closed position. For the sake of simplification, the watch itself has been omitted.

Simultaneously considering now FIG. 1 and FIG. 2*a*, it is clear that when the bracelet strands are opened out, as illustrated in the top view of FIG. 1, the contact surface of the first strand 5 is underneath end part 8, whereas the contact surface of second strand 6 is on top of the second end part 9. According to the invention, the bracelet further includes a first magnetic circuit portion integrated in first end part 8 and a plurality of second magnetic circuit portions integrated in second end part 9. Referring again to FIG. 1, it can be seen that in the illustrated embodiment, the first end part 8 has two first magnetic circuit portions (respectively referenced 11*a*, 11*b*), whereas the second end part 9 comprises six second magnetic circuit portions 12*a*, 12*b*, 12*c*, 12*d*, 12*e* and 12*f*. Those skilled in the art will understand that generally speaking, there may be practically any number of portions. It may be noted however that the number of second magnetic circuit portions must be at least equal to two. Further, the number of first magnetic circuit portions is preferably smaller than or equal to the number of second magnetic circuit portions. As a general rule, a higher number of first and second magnetic circuit portions leads to a greater force of attraction and improved reliability. By way of example, an even more reliable embodiment than that of FIG. 1 could comprise 8 first and sixteen second magnetic circuit portions. This latter embodiment will have the drawback of being slightly more expensive.

Referring now to FIG. 1, it can be seen that, in the present example, the first magnetic circuit portions 11*a*, 11*b*, like the second portions 12*a*, 12*b*, 12*c*, 12*d*, 12*e*, 12*f* are arranged parallel to each other and spaced apart from each other. It can also be seen that the magnetic circuit portions each extend over a length which is practically equal to the width of the bracelet. Indeed, advantageously, the length of the magnetic circuit portions exceeds half the width of the bracelet. Further, it can also be seen that, in the example shown, the space which separates two second magnetic circuit portions 12*a*, 12*b*, 12*c*, 12*d*, 12*e*, 12*f* is at least equal to three-quarters of the width of one of the second magnetic circuit portions. Finally it will be noted, by way of example, that FIG. 1 also indicates possible numerical values for the size of the spaces which separate a first or a second magnetic circuit portion from its closest neighbour. The Figure shows that the first magnetic circuit portions 11*a* and 11*b* are 4 mm apart. Moreover, second magnetic circuit portions 12*a* and 12*b* are 3.405 mm apart, second portions 12*b* and 12*c* are 3.375 mm apart, portions 12*c* and 12*d* are 3.36 mm apart, portions 12*d* and 12*e* are 3.34 mm apart and finally portions 12*e* and 12*f* are 3.32 mm apart. These values illustrate the fact that the space between the second portions is preferably smaller than the space between first portions 11*a*, 11*b*. In the closed position of the bracelet, this advantageous feature compensates for the smaller radius of curvature of the second end part.

The numerical values given above for the size of the spaces which separate two second magnetic circuit portions also illustrate the fact that the space between the second magnetic circuit portions preferably gradually decreases away from the end of the second end part 9 of the bracelet. Indeed, the further away the second magnetic circuit portions (on which the first magnetic circuit portions are superposed) are from the end of the bracelet, the tighter the bracelet will be, or, in other words the smaller the diameter of the bracelet will be. In these conditions, it will be clear that the tighter the bracelet is, the more necessary it will be to reduce the space between the second magnetic circuit portions in order to correct the overlapping effect of the end parts and to ensure that the first and second magnetic circuit portions are properly aligned in the closed position of the bracelet.

Figure 2B:
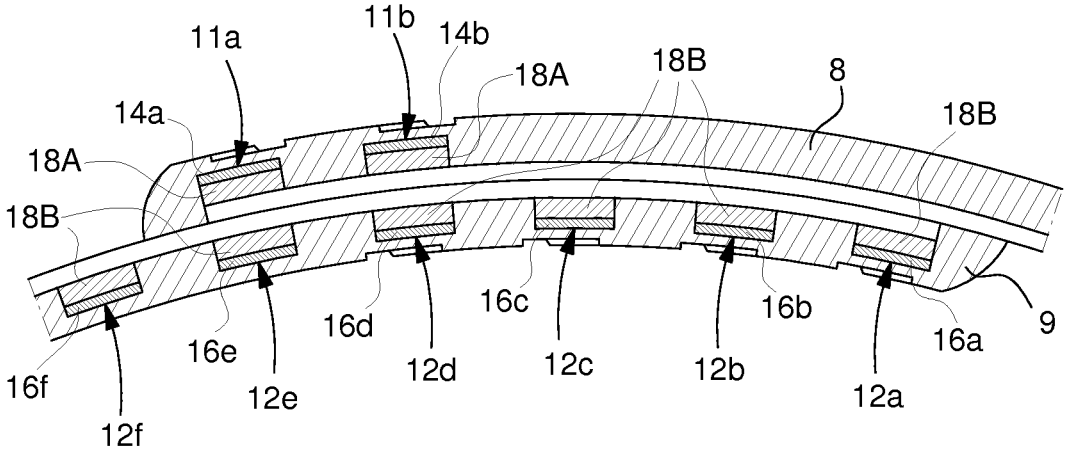
FIG. 2*b* is a partial cross-section showing in more detail the magnetic clasp of the bracelet of FIG. 2*a*, and showing in particular the overlapping of the two end parts of the bracelet in the overlapping area.

According to the invention, magnetic circuit portions 11*a*, 11*b*, 12*a*, 12*b*, 12*c*, 12*d*, 12*e*, 12*f* all include a soft ferromagnetic alloy yoke (referenced respectively 14, 14*b*, 16*a*, 16*b*, 16*c*, 16*d*, 16*e* and 16*f* in FIG. 2*b*). As will be seen in more detail below, in the present example, the yokes take the form of small rectangular plates arranged in the thickness of the bracelet, transversely to the longitudinal axis of the bracelet and parallel to the contact surface with the other bracelet strand. According to the invention, first magnetic circuit portions 11*a* and 11*b*, integrated in the first end part of the bracelet each include a row of magnets 18A. Moreover, in the present example, the second magnetic circuit portions in the end part of the bracelet are also provided with magnets 18B. As will be seen in more detail in relation to FIGS. 3*a* and 3*b*, each row of bipolar magnets is arranged between one of the yokes and the contact surface with the other bracelet strand.

Simultaneously considering FIG. 1 and FIG. 2*b* now, it is possible to understand that by longitudinally shifting one of the end parts in relation to the other, the bracelet can be made to take seven possible different lengths in the closed position. FIG. 2*b* shows that first magnetic circuit portions 11*a* and 11*b* have been shown superposed on second magnetic circuit portions 12*e* and 12*d*. However, it can be seen that, in order to obtain the shortest possible bracelet length, first magnetic circuit portion 11*b* must be superposed on second magnetic circuit portion 12*f*. Conversely, it can also be seen that the longest bracelet length may be obtained by superposing the first magnetic circuit portion 11*a* on the second magnetic circuit portion 12*a*. It may be noted that, in the two positions which have just been mentioned, only one of the first magnetic circuit portions cooperates with a second magnetic circuit portion, since the other first magnetic circuit portion is not situated opposite a second magnetic circuit portion. It will therefore be clear from the foregoing that the magnetic clasp will be stronger in the five positions corresponding to intermediate bracelet lengths than in the two end positions which respectively correspond to the shortest length and to the longest length.

Since the magnetic force of attraction decreases with distance, this force is mainly exerted between the first and second magnetic circuit portions closest to each other. As these closest portions are generally substantially superposed, the magnetic force is exerted, above all, perpendicular to the contact surfaces. Thus, the attraction between the magnetic circuit portions has the effect of causing the contact surfaces to adhere strongly to each other. Moreover, it will be clear that the magnetic attraction force also resists any longitudinal sliding of the contact surfaces against each other. This latter feature has the advantage of permitting flat contact surfaces to be used between the bracelet strands, and thus of omitting notches or any other mechanical immobilising means. It can thus be said that the first and second magnetic circuit portions perform the function of "magnetic notches".

Figure 3A:
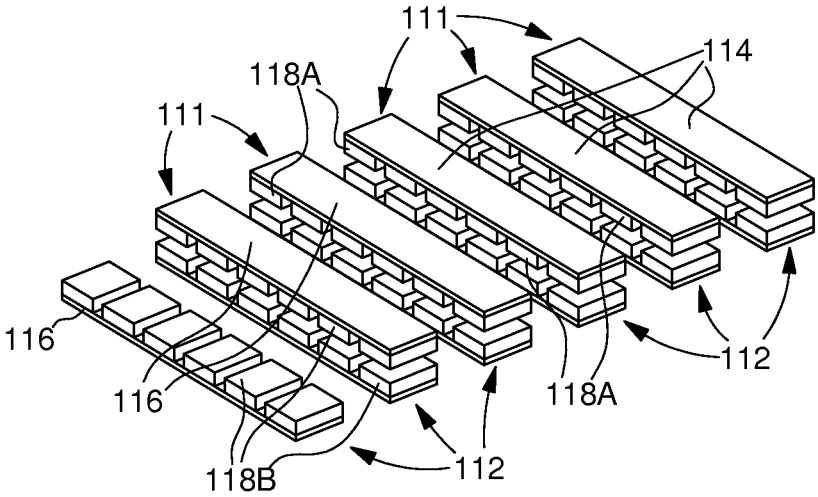
FIG. 3*a* is a schematic diagram of the magnetic clasp of a bracelet according to a second embodiment of the invention, and showing, in perspective, the arrangement of the first and second magnetic circuit portions in the closed position of the bracelet.
Figure 3B:
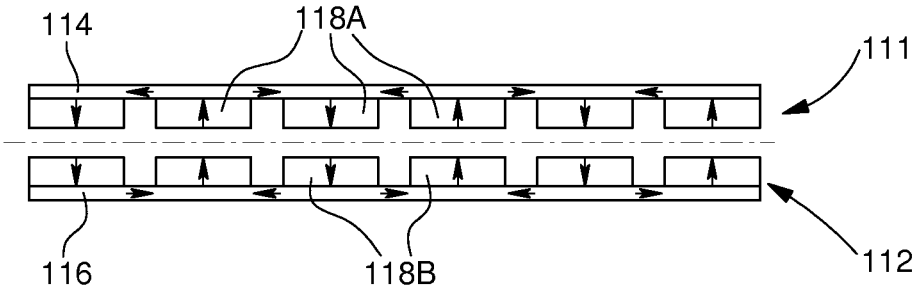
FIG. 3*b* is a partial front view of the embodiment of FIG. 3*a* showing in more detail the cooperation between the magnets of one of the first magnetic circuit portions with the magnets of one of the second magnetic circuit portions, in the closed position of the bracelet.

FIGS. 3*a* and 3*b* are two partial schematic views of the arrangement of first and second magnetic circuit portions which forms the magnetic clasp of a bracelet according to a second embodiment of the invention. The first and second magnetic circuit portions used in this second embodiment may be identical to those used in the first embodiment described above. The difference between the first and second embodiment essentially lies in the use of a larger number of first and second magnetic circuit portions for the second embodiment. As shown in FIG. 3*a*, the first magnetic circuit portions 111 are arranged parallel to each other and spaced regularly apart from each other. The same is true of the second magnetic circuit portions 112.

According to the invention, the first and second magnetic circuit portions 111 and 112 each include a soft ferromagnetic alloy yoke (referenced 114 for the first portions and 116 for the second). In the embodiment described, as in the preceding embodiment, the yokes take the form of small rectangular plates. They may be made for example by cutting a laminated iron-cobalt alloy strip such as those supplied by ArcelorMittal® under the name AFK502. In the example described, the length of the yokes is 25.75 mm, the width is 4 mm and thickness is 0.5 mm. As also shown in FIGS. 3*a* and 3*b*, in each magnetic circuit portion, a yoke is associated with a row of six magnets (the magnets being collectively referenced 118). In the present example, the magnets have a length of 4 mm, a width of 3.25 mm, and a height of 1 mm. By way of example, the magnets used may be standard magnets made of neodymium-iron-boron.

FIGS. 3*a* and 3*b* also show that magnets 118 are arranged between a yoke 14 or 16 and the contact surface between the two bracelet strands (represented by a dash and dotted line in FIG. 3*b*). The magnets are regularly spaced apart on the yoke with a space of 1.25 mm between neighbouring magnets. It can also be seen that the magnets of a first magnetic circuit portion 111 are shown in a superposed position on the magnets of a second magnetic circuit portion 112. Thus, according to the embodiment shown, magnets 118 of the first portions are each matched with a magnet 118 of a second portion in the closed position of the bracelet.

According to the invention, the magnets are all polarised normally to the contact surface between the end parts of the bracelet strands. In this regard, it can be seen that the normal to the contact surface is the vertical in FIGS. 3*a* and 3*b*. On the other hand, it will be clear that, although magnets 118 are all polarised vertically, some magnets of a row are preferably polarised in the opposite direction to the other magnets of the row. Thus, in FIG. 3*b* also shows that some magnets 118 are polarised upwards, whereas the other magnets are polarised downwards (as indicated by the arrows). However, it will also be noted that two superposed magnets (or in other words, two matched magnets) are always polarised in the same direction. Finally, it will also be noted that in the example shown, each magnet 118 is polarised in the opposite direction to its closest neighbour in the row of magnets. Referring again to FIG. 3*b*, it can be seen that the direction of magnetisation in the yokes is indicated by arrows. It can be seen from the arrows that the arrangement which has just been described of magnets 118 and of yokes 114, 116 reduces the magnetic path so as to improve coupling while limiting magnetic pollution.

Figure 4:
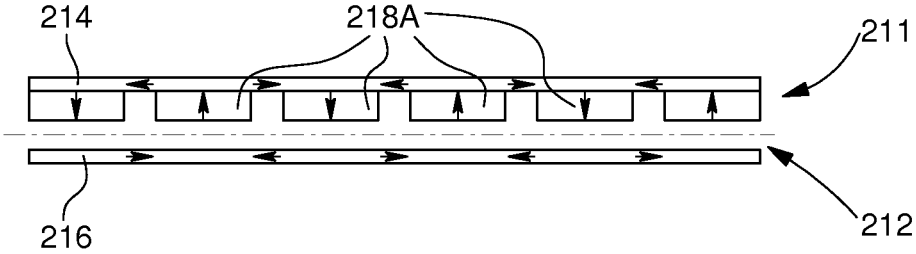
FIG. 4 is a schematic diagram of the magnetic clasp of a bracelet according to a third embodiment of the invention, and showing a front view of the cooperation between a first magnetic circuit portion and a second magnetic portion in the closed position of the bracelet.

It will also be clear that various alterations and/or improvements evident to those skilled in the art may be made to the embodiments forming the subject of this specification without departing from the scope of the present invention defined by the annexed claims. In particular, those skilled in the art will understand that the second magnetic circuit portions 216 may not include any magnets. Indeed, referring now to FIG. 4, it can be seen that only the first magnetic circuit portions 214 include magnets 218.

What is claimed is:

1. A bracelet or wristband with a magnetic clasp comprising a first and a second flexible end part in the form of a strap portion, said end parts being separable and being arranged to overlap in the closed position of the bracelet so that the bracelet substantially forms a ring with an external side and an internal side and so that the end parts define an overlapping area, the end parts each having a contact surface arranged to adjoin the contact surface of the other end part in the overlapping area so that the first end part is on the external side of the ring and the second end part is on the internal side, the bracelet comprising a first magnetic circuit portion integrated in the first end part and a second magnetic circuit portion integrated in the second end part, said first and second magnetic circuit portions being arranged to mutually attract each other and to cooperate so as to unite the contact surfaces of the two end parts in the closed position of the bracelet;

wherein the first and second magnetic circuit portions each include a soft ferromagnetic alloy yoke, said yoke having an elongated shape and being arranged transversely to the bracelet and parallel to the contact surface of the end part in which the magnetic circuit portion is integrated, in that said first magnetic circuit portion includes a row of bipolar magnets arranged between the ferromagnetic yoke and the contact surface of the first end part, the magnets of said row having directions of polarisation that are parallel to each other and normal to the contact surface of the first end part, and in that a plurality of second magnetic circuit portions are integrated in the second end part, said second portions are arranged parallel to each other and spaced apart from each other so as to enable the bracelet length to be selected.

2. The bracelet with a magnetic clasp according to claim 1, wherein the length of the ferromagnetic yokes is greater than half the width of the end parts in the form of a strap portion.

3. The bracelet with a magnetic clasp according to claim 1, wherein the space between two second magnetic circuit portions is at least equal to three-quarters of the width of one of the second magnetic circuit portions.

4. The bracelet with a magnetic clasp according to claim 1, wherein several first magnetic circuit portions are integrated in the first end part, said first portions being arranged parallel to each other and spaced apart from each other.

5. The bracelet with a magnetic clasp according to claim 4, wherein the first magnetic circuit portions are spaced further apart from each other than the second magnetic circuit portions.

6. The bracelet with a magnetic clasp according to claim 5, wherein the second magnetic circuit portions are more numerous than the first magnetic circuit portions, and the space between the second magnetic circuit portions increases gradually towards the end of the second end part.

7. The bracelet with a magnetic clasp according to claim 1, wherein the second magnetic circuit portions each include a row of bipolar magnets arranged between the ferromagnetic yoke of the second portion and the contact surface of the second end part, the magnets of a row having directions of polarisation that are parallel to each other and normal to the contact surface of the second end part, and wherein the rows of magnets of the first and second magnetic circuit portions all have the same number of magnets, the magnets being arranged so that the magnets of the first portions can each be matched with a magnet of a second portion in the closed position of the bracelet, two matched magnets being superposed and polarised in the same direction.

8. The bracelet with a magnetic clasp according to claim 1, wherein the direction of polarisation of some magnets of a row is in the opposite direction to the direction of polarisation of the other magnets of the same row.

9. The bracelet with a magnetic clasp according to claim 8, wherein each magnet of a row of magnets is polarised in the opposite direction to the closest neighbour thereto in the row of magnets.

10. The bracelet with a magnetic clasp according to claim 1, wherein the first and second end parts each include an elastomer layer in which the magnetic circuit portions are embedded.

* * * * *